US008438870B2

(12) United States Patent
Leclear et al.

(10) Patent No.: US 8,438,870 B2
(45) Date of Patent: May 14, 2013

(54) REFRIGERATOR DOOR VACUUM PRESERVATION SYSTEM

(75) Inventors: Douglas David Leclear, Benton Harbor, MI (US); Michele E. Wilcox, Stevensville, MI (US); John J. Vonderhaar, Saint Joseph, MI (US); Paul B. Allard, Stevensville, MI (US); Kelly M. Hanson, Euclid, OH (US); Andrew Michael Tenbarge, Saint Joseph, MI (US); Karen J. Querfurth, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 410 days.

(21) Appl. No.: 12/694,313

(22) Filed: Jan. 27, 2010

(65) Prior Publication Data

US 2010/0126117 A1 May 27, 2010

Related U.S. Application Data

(62) Division of application No. 12/026,919, filed on Feb. 6, 2008, now Pat. No. 7,669,434.

(51) Int. Cl.

| | |
|---|---|
| ***F25D 25/00*** | (2006.01) |
| ***B65B 31/00*** | (2006.01) |
| ***B65B 59/00*** | (2006.01) |
| ***B65B 57/00*** | (2006.01) |

(52) U.S. Cl.

USPC ..... 62/377; 53/434; 53/512; 53/77

(58) Field of Classification Search ..... 62/331, 62/440, 531, 169, 268; 53/432, 434, 510, 53/512, 77; 99/472

See application file for complete search history.

(56) References Cited

U.S. PATENT DOCUMENTS

| | | | | |
|---|---|---|---|---|
| 4,941,310 | A * | 7/1990 | Kristen | 53/512 |
| 5,271,240 | A * | 12/1993 | Detrick et al. | 62/268 |
| 5,711,136 | A * | 1/1998 | Carcano | 53/434 |
| 6,694,710 | B2 * | 2/2004 | Wang | 53/512 |
| 7,231,753 | B2 * | 6/2007 | Patterson et al. | 53/512 |
| 7,377,087 | B2 * | 5/2008 | Clarke et al. | 53/434 |
| 7,454,884 | B2 * | 11/2008 | Kahn et al. | 53/512 |
| 7,478,516 | B2 * | 1/2009 | Higer et al. | 53/512 |
| 7,484,346 | B2 * | 2/2009 | Baptista | 53/512 |
| 7,540,127 | B2 * | 6/2009 | Sung et al. | 53/512 |
| 7,596,930 | B2 * | 10/2009 | Borchardt | 53/434 |
| 2003/0140603 | A1 * | 7/2003 | Krasenics et al. | 53/434 |
| 2004/0231294 | A1 * | 11/2004 | Shannon | 53/434 |

(Continued)

*Primary Examiner* — Frantz Jules
*Assistant Examiner* — David S Einfeldt
(74) *Attorney, Agent, or Firm* — Kirk W. Goodwin; Diederiks & Whitelaw PLC

(57) ABSTRACT

A refrigerator includes a hands-free vacuum preservation system mounted on a door of the refrigerator comprising a main body portion having a slot therein for receiving an open end of a plastic bag. Sensors within the slot detect the presence of the bag and a retaining device is actuated to punch holes in the bag and retain the bag in position for a vacuum sealing event. An intake port within the system communicates with a vacuum source to remove air from the bag, and a heat sealer seals the bag closed. In a preferred embodiment, once sensors located on the main body portion detect the presence of a consumer's hand, the retaining device releases the bag. The resultant vacuum sealed bag can be stored in a conventional manner, or by hanging the bag from hooks extending through the holes formed therein by the retaining device.

9 Claims, 6 Drawing Sheets

U.S. PATENT DOCUMENTS

2005/0172834 A1* 8/2005 Lee ..... 99/472
2006/0010890 A1* 1/2006 Feinauer et al. ..... 62/169
2006/0090427 A1* 5/2006 Hau et al. ..... 53/512
2007/0033907 A1* 2/2007 Small et al. ..... 53/512
2008/0104931 A1* 5/2008 Hatchell et al. ..... 53/432
2009/0007523 A1* 1/2009 Alipour et al. ..... 53/434
2009/0194193 A1* 8/2009 Vonderhaar et al. ..... 141/65
2009/0229224 A1* 9/2009 Allard et al. ..... 53/432
2009/0229278 A1* 9/2009 Biotti et al. ..... 62/89
2010/0139303 A1* 6/2010 Feng et al. ..... 62/268
2011/0289885 A1* 12/2011 Re et al. ..... 53/432
2012/0090281 A1* 4/2012 Abate et al. ..... 53/510

* cited by examiner

REFRIGERATOR DOOR VACUUM PRESERVATION SYSTEM

CROSS-REFERENCE TO RELATED APPLICATIONS

The present application represents a divisional of U.S. patent application Ser. No. 12/026,919 entitled "Refrigerator Door Vacuum Preservation System" filed Feb. 6, 2008, currently allowed.

BACKGROUND OF THE INVENTION

1. Field of the Invention

The present invention pertains to the art of refrigerators, and more specifically, to a vacuum preservation system for a refrigerator door.

2. Description of the Related Art

It is well known that exposure to oxygen over time promotes deterioration of food products. Therefore, packaging food in vacuum sealed containers aids in preserving food products and extending their shelf life. In addition to extending the storage life of food, vacuum-sealed plastic bags may aid in optimizing food storage space.

Countertop vacuum sealers, such as those produced by Foodsaver®, are commonly used to extend the storage time of refrigerated or frozen foods. However, such countertop devices take-up valuable counter and storage space, and must typically be plugged and unplugged for every use. As a solution to the cumbersome nature of the countertop device, some patent documents have proposed integrating vacuum sealing devices into refrigerators. One such device, disclosed in U.S. Patent Application Publication No. 2006/0090427, proposes a system wherein a vacuum hose connects a port on the front of a refrigerator with a port on a canister to vacuum seal the canister. However, such a system requires a consumer to utilize a specialized canister to match the particular vacuum hose assembly. Additionally, with no resting place for the container, a consumer has the awkward task of holding the container while connecting the vacuum hose and must either set the container on a nearby support surface or hold the container until the vacuum sealing process is completed.

Based on the above, there exists a need in the art for a hands-free vacuum sealing arrangement within a refrigerator that does not require a consumer to use specialized containers or attachments.

SUMMARY OF THE INVENTION

The present invention is directed to a refrigerator door vacuum preservation system and method of use. The vacuum preservation system comprises a main body portion located in the refrigerator door including a slot therein adapted to receive an open end of a flexible plastic container or bag. A sensor located within the main body portion detects the presence of the bag in the slot and actuates a retaining device to hold the bag in position during a vacuum sealing operation. In the preferred embodiment, at least one pin forms a hole in the end portion of the plastic bag to aid in retaining the bag in position. A vacuum source is then activated to remove air from the bag via a vacuum intake port in the refrigerator door, and a heat sealer located within the main body portion is then activated to seal the bag. The bag is released upon actuation of a control button, upon completion of the sealing operation or when hand sensors detect the presence of a consumer's hand in the vicinity of the main body portion of the system. After being sealed, the bag may be stored in a conventional manner, or may be hung from pegs located within a refrigerated compartment of the refrigerator utilizing the hole formed in the bag by the retaining device. With this system, a user is provided a convenient hands-free method of vacuum sealing food that does not require additional storage space or a dedicated appliance, while allowing food to be stored in a space-saving manner within a refrigerator compartment.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
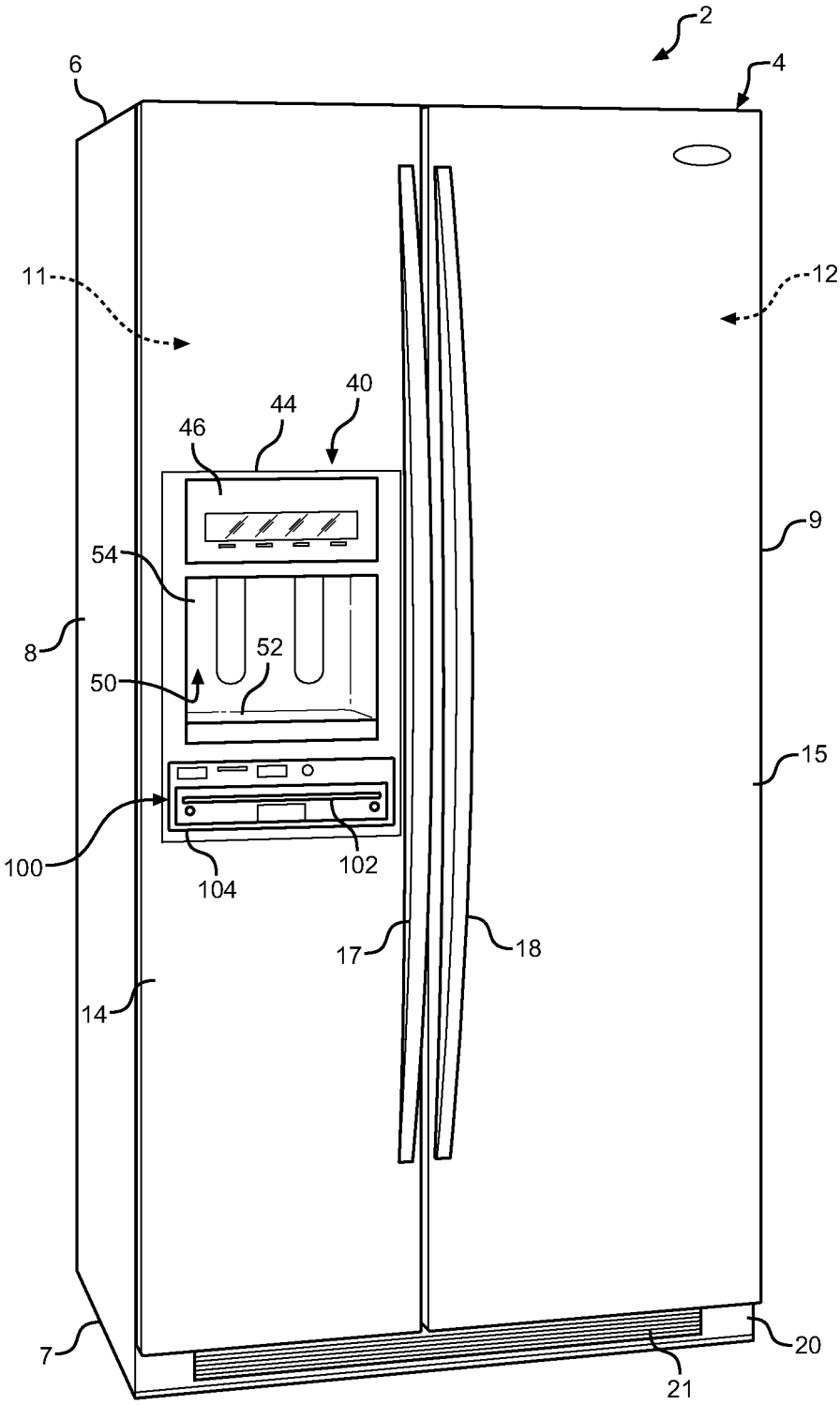
FIG. 1 is a perspective view of a side-by-side refrigerator having a door including a vacuum preservation system constructed in accordance with the present invention.

With initial reference to FIG. 1, a refrigerator constructed in accordance with the present invention is generally indicated at 2. Refrigerator 2 includes a cabinet 4 having a top wall 6, a bottom wall 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14 and 15 includes an associated handle 17 and 18. Refrigerator 2 is also shown to include a kick plate 20 arranged at a bottom portion thereof having a vent 21 that permits air to flow to refrigeration components (not shown) located within a machine compartment 24 (shown schematically in FIG. 4) for housing the various refrigeration components that establish and maintain desired temperatures in freezer compartment 11 and fresh food compartment 12 in a manner known in the art. In the embodiment shown, refrigerator 2 constitutes a side-by-side model. However, it should be understood that the present invention could also be employed in connection with a wide variety of refrigerators, including top mount, bottom mount, and French door style refrigerator models.

Figure 2:
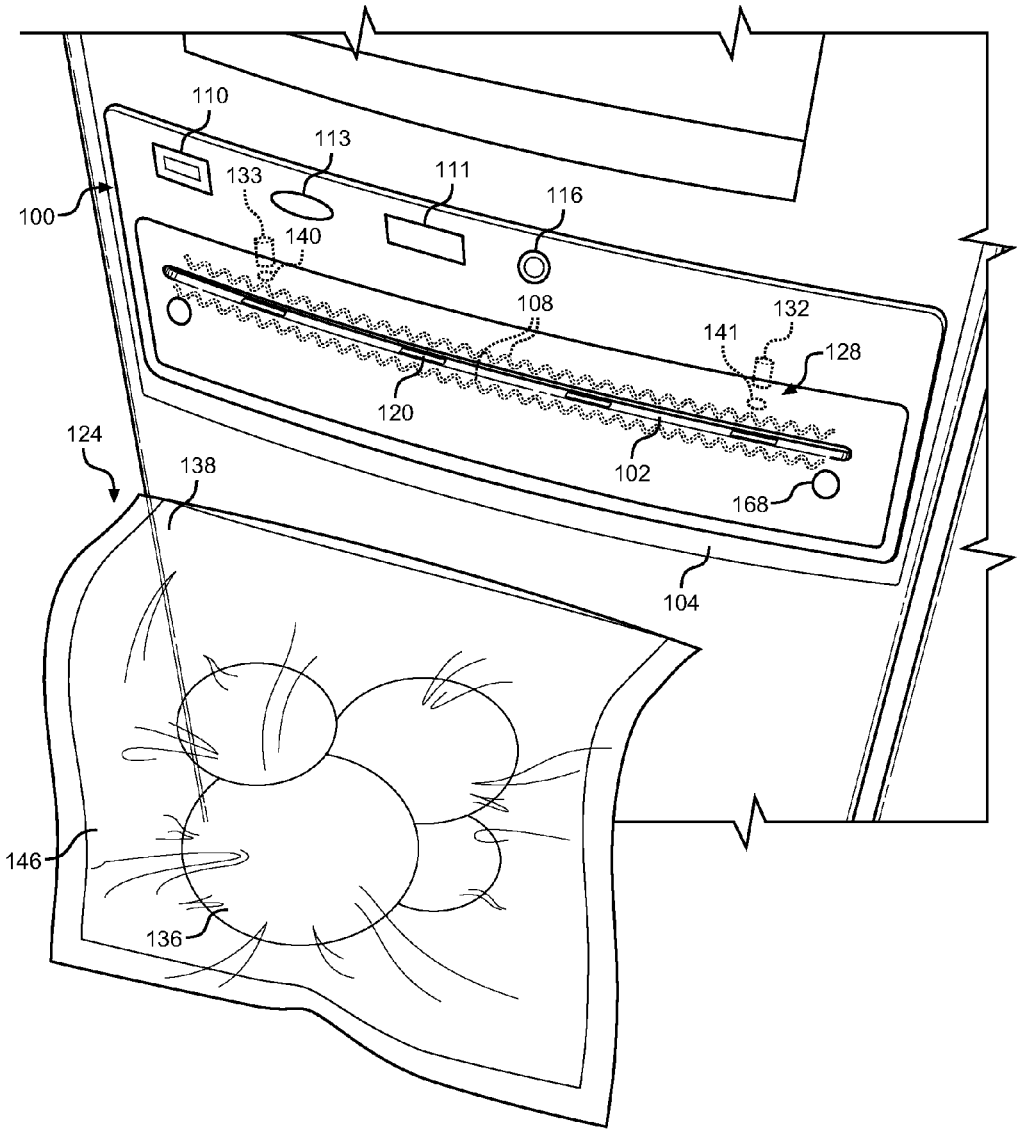
FIG. 2 is an enlarged view of the vacuum preservation system depicted in FIG. 1.
Figure 3:
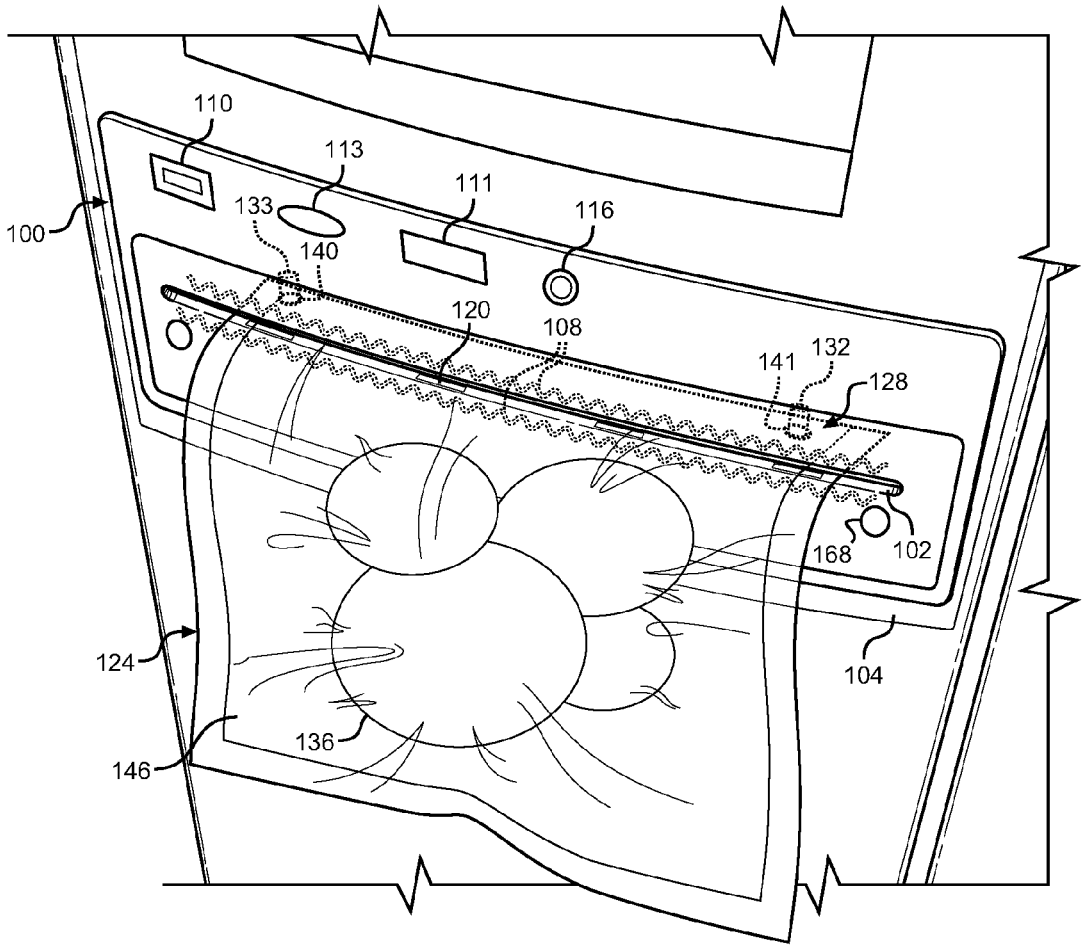
FIG. 3 is an enlarged view of the vacuum preservation system depicted in FIG. 1 in a retaining position.
Figure 4:
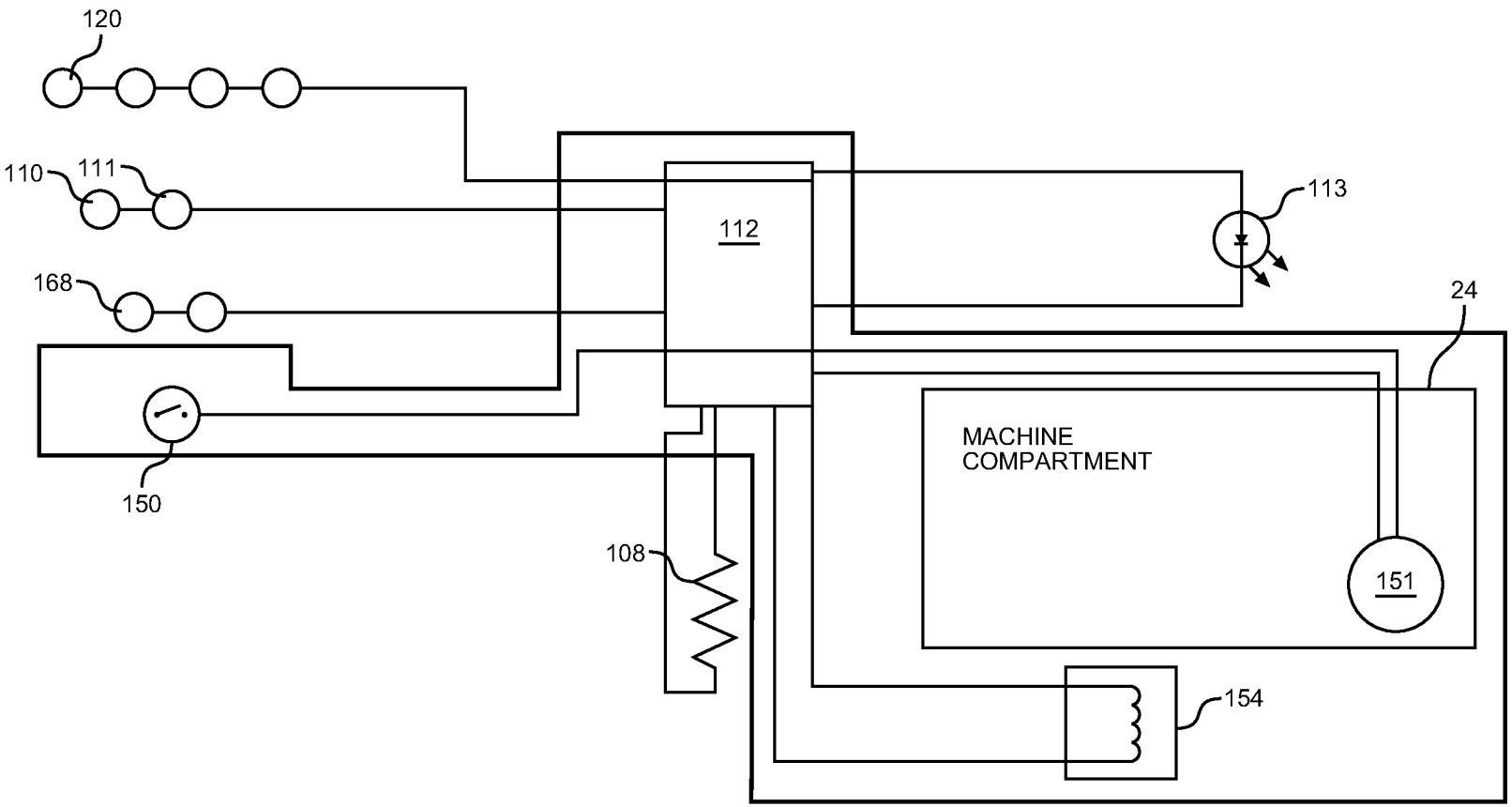
FIG. 4 is a control schematic for the vacuum preservation system of the present invention.

In accordance with a preferred embodiment of the present invention, refrigerator 2 includes a dispenser assembly 40 having a main housing 44 and a control panel 46. Additionally, dispenser assembly 40 includes a dispenser well 50 having a base or container support portion 52 and a recessed, upstanding wall section 54. Dispenser assembly 40 is adapted to dispense water and/or ice in a manner well known in the art. However, in accordance with the present invention, incorporated into the main housing 44 of dispenser assembly 40 is a vacuum preservation system 100. As depicted in FIGS. 2-4, vacuum preservation system 100 comprises an intake channel or slot 102 located within a main body portion 104, at least one heating element 108, a plurality of control elements 110 and 111, and a main controller 112 operatively connected to heating element 108 and the plurality of control elements 110 and 111. In the embodiment shown, control element 110 constitutes a power switch and control element 111 defines a stop button for manually canceling a vacuum cycle and sealing operation. Additionally, one or more indicators 113 may be utilized to convey the status of a vacuum sealing operation to a user. In the preferred embodiment, indicator 113 is a light emitting diode (LED) indicator. Optionally, system 100 includes a pressure port 116 located on main body portion 104. Pressure port 116 can lend itself to numerous applications, including the ability of a consumer to blow up balloons using compressed air supplied through pressure port 116.

System 100 also includes a flexible plastic container or bag retention system comprising one or more sensors indicated at 120 for sensing the presence of a bag 124 within slot 104, and a retaining device 128 adapted to hold bag 124 in position during a vacuum sealing event. In a preferred embodiment, retaining device 128 includes first and second, laterally spaced pins 132 and 133 adapted to create apertures in bag 124 to retain bag 124 in position during vacuum sealing, as well as provide hanging storage options as will be discussed further below. Although only two pins 132, 133 are shown, it should be understood that any desired number of pins may be utilized in connection with the present invention.

In use, items 136 to be vacuum packaged are placed inside a bag 124 and the open end of bag 124 is inserted into slot 102 of vacuum preservation system 100. The presence of an end portion of bag 124 in slot 102 is detected by at least one sensor 120, and the retaining device 128 is actuated to hold bag 124 in a proper position for a vacuum sealing event. More specifically, first and second pins 132 and 133 are extended through an end portion 138 of bag 124 and cooperate with respective apertures 140 and 141 in a plate (not shown) to form holes in bag 124 and retain bag 124 in slot 102.

Optionally, a consumer may utilize a bag having preformed apertures therein (not shown). In this case, a consumer aligns the apertures in the bag with corresponding pins and, upon sensing the presence of the bag, retaining device 128 extends the pins through the apertures in the bag to retain the bag in place. Regardless of the type of bag utilized, it is important to note that the use of retaining device 128 allows for a hands-free vacuum sealing operation. More specifically, main body portion 104 is substantially flush with door 14 such that, when end portion 138 of bag 124 is held within slot 102, the remaining main body portion 146 of bag 124 hangs vertically from slot 102, substantially parallel with refrigerator door 14 as depicted in FIG. 3. In this configuration, any fluids within bag 124 will advantageously settle to the bottom of the bag such that a user need not worry about liquid spilling from bag 124 as it is being vacuum sealed.

Figure 5:
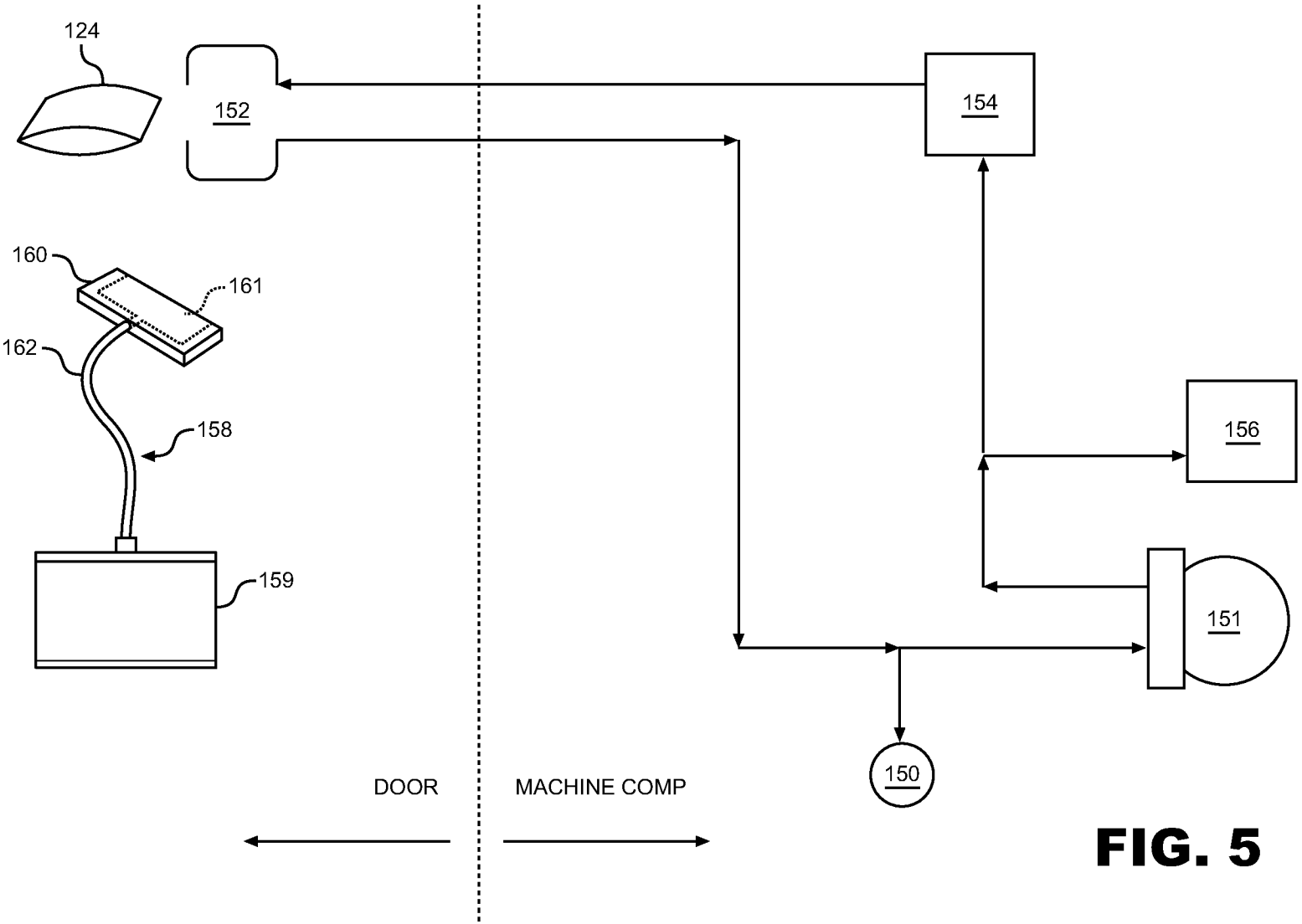
FIG. 5 depicts a vacuum piping configuration for the vacuum preservation system of the present invention.

With reference to FIGS. 4 and 5, once bag 124 is properly retained within slot 102, a vacuum pressure switch 150 is actuated by controller 112 and communicates with a vacuum source 151 to draw a predetermined vacuum in bag 124 via a vacuum intake port 152. Preferably, the vacuum pressure source 151 is defined by the compressor employed in connection with the refrigeration system for refrigerator 2 and located in machine compartment 24. In this configuration, the noise level from the vacuum source 151 is diminished, along with overall appliance costs. Alternatively, the vacuum preservation system may include its own vacuum pump (not shown). After air is evacuated from bag 124, a solenoid valve 154 is actuated, releasing pressure through a pressure release valve 156. The layers of end portion 138 of bag 124 are then melted in a conventional manner utilizing heating element 108 to create a seal.

To supplement the vacuum preservation system 100 described above, an adapter assembly 158 can be provided to allow a user to vacuum seal storage containers, such as rigid plastic containers 159, rather than flexible plastic bags 124. In accordance with this aspect of the invention, adapter assembly 158 includes a thin, elongated main body portion 160 including a vacuum slot 161 formed therein in communication with a hose 162. In use, elongated main body portion 160 is inserted into slot 102 such that vacuum intake port 152 communicates with vacuum slot 161 of adapter assembly 158 and hose 162. Hose 162 can be attached to container 159 such that a vacuum is applied to container 159 to remove air therefrom. In this embodiment, vacuum preservation system 100 preferably includes a means for preventing retaining device 128 from actuating when adaptor assembly 158 is in use. In the alternative, main body portion 160 is made of a hard material which cannot be penetrated by pins 132 and 133 regardless of the actuating of retaining device 128.

With respect to power utilized by vacuum pressure system 100, it is preferable that power drawn by the hardware on door 14 be minimized. To achieve this, a double pole double throw switch (not shown) is preferably used to prevent an ice maker 164 and auger 166 (depicted in FIG. 6), as well as heating element 108, from operating at the same time. This system prevent excessive simultaneous power draw, and eliminates the need for additional wires to be run into the door.

Figure 6:
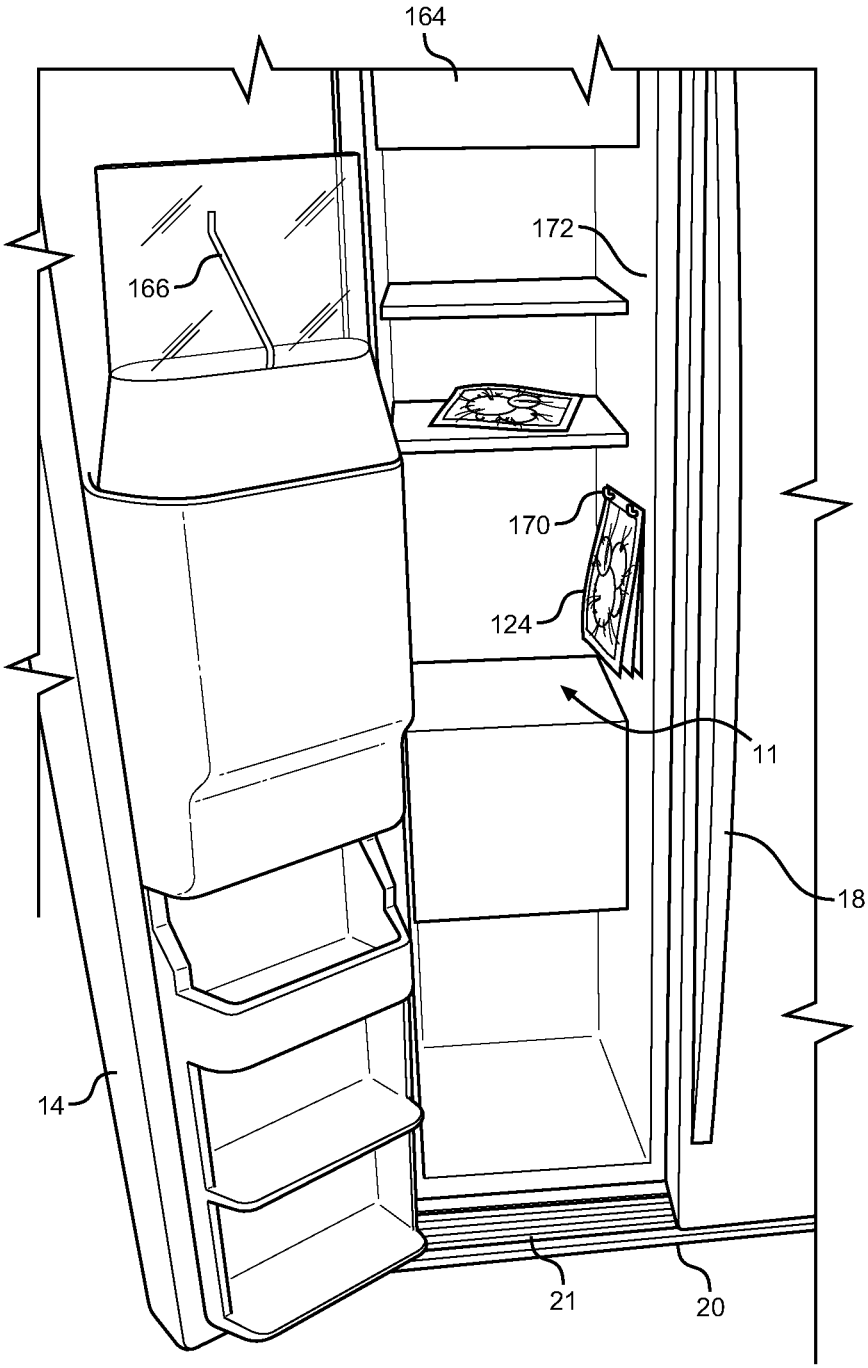
FIG. 6 is a partial perspective view of a compartment of the refrigerator shown in FIG. 1.

Once bag 124 is sealed, a user may utilize a control element or button, such as indicated at 110 or 111 in FIG. 4, to release bag 124 from retaining device 128. Optionally, sensors 168 may be provided to sense the presence of a user's hands, at which point retaining device 128 would release bag 124 automatically. Upon removal of bag 124 from slot 102, bag 124 may be stored in freezer compartment 11 or fresh food compartment 12 for further preservation. In one preferred embodiment, one or more pegs or hooks 170 extending from a wall of freezer or fresh food compartments 11 or 12, may be utilized to store bag 124 in a space-saving hanging position within refrigerator 2. For example, as depicted in FIG. 6, bag 124 may be stored in a hanging position from a side wall 172 of freezer compartment 11. This novel food storage option makes the most use of the storage space within refrigerator 2, without the need for any specialized containers or container accessories.

Advantageously, the present invention provides a low-noise, hands-free system for vacuum sealing food products. Additionally, the present system provides a means for efficiently storing vacuum-sealed food. Although described with reference to a preferred embodiment of the invention, it should be readily understood that various changes and/or modifications can be made to the invention without departing from the spirit thereof. For instance, the vacuum preservation system need not be part of the dispenser but rather could be located in other portions of the freezer or fresh food doors, or even within the refrigerator. In addition, although a pin is the desired means for retaining a bag within the system, other retention devices, including a clamping or pinching unit could be employed. In general, the invention is only intended to be limited by the scope of the following claims.

What is claimed is:

1. A method of vacuum preserving food utilizing a vacuum preservation system including a main body portion having an intake channel and a vacuum intake port in communication with a vacuum source incorporated into a refrigerator, the method comprising:

inserting an end portion of a flexible plastic container into the intake channel;

activating a retaining device of the vacuum preservation system to retain the flexible plastic container in position for a vacuum sealing operation;

actuating the vacuum source to remove air from the flexible plastic container via the vacuum intake port;

sealing the flexible plastic container utilizing a heat sealer of the vacuum preservation system; and deactivating the retaining device to release the flexible plastic container upon either completing the sealing of the flexible plastic container or sensing the presence of a hand of a consumer near the main body portion.

2. The method of claim 1, further comprising:

sensing the presence of the end portion of the flexible plastic container within the intake channel, wherein the retaining device is actuated based on the presence of the end portion of the flexible plastic container within the intake channel.

3. A method of vacuum preserving food utilizing a vacuum preservation system including a main body portion having a intake channel and a vacuum intake port in communication with a vacuum source incorporated into a refrigerator, the method comprising:

inserting an end portion of a flexible plastic container into the intake channel;

sensing the presence of the end portion of the flexible plastic container within the intake channel;

activating a retaining device of the vacuum preservation system to retain the flexible plastic container in position for a vacuum sealing operation, wherein the retaining device is actuated based on the presence of the end portion of the flexible plastic container within the intake channel and wherein the retaining device constitutes at least one pin for punching a hole in the end portion of the flexible plastic container when the presence of the end portion of the flexible plastic container is sensed within the intake channel;

actuating the vacuum source to remove air from the flexible plastic container via the vacuum intake port;

sealing the flexible plastic container utilizing a heat sealer of the vacuum preservation system; and deactivating the retaining device to release the flexible plastic container.

4. The method of claim 1, further comprising: selectively supplying pressurized air to a pressure port located on the main body portion.

5. The method of claim 3, further comprising: selectively supplying pressurized air to a pressure port located on the main body portion.

6. The method of claim 1, further comprising: hanging the flexible plastic container in a storage position from a hook extending from a side wall in the refrigerator.

7. The method of claim 3, further comprising: hanging the flexible plastic container in a storage position from a hook extending from a side wall in the refrigerator.

8. A method of vacuum preserving food in a refrigerator including: a cabinet; a machine compartment arranged within the cabinet; at least one refrigerated compartment arranged within the cabinet; a door mounted to the cabinet for selectively providing access to the at least one refrigerated compartment; and a vacuum preservation system for selectively vacuum sealing a container, the method comprising:

a) when used with a flexible plastic container:

positioning an end portion of the flexible plastic container in an intake channel of a main body portion of the vacuum preservation system;

removing air from within the flexible plastic container utilizing a vacuum intake port exposed to the intake channel and in fluid communication with a vacuum source during the vacuum sealing operation;

activating a heat sealer located within the main body portion to seal the end portion of the flexible plastic container; and b) when used with a rigid container:

inserting an adapter assembly having a body portion with a vacuum slot into the intake channel;

extending a hose from the body portion to a vacuum port of the rigid container; and drawing a vacuum from the rigid container.

9. The method of claim 1, further comprising, for use with the flexible plastic container:

sensing a presence of the end portion of the flexible plastic container within the intake channel; and holding the end portion of the flexible plastic container in place within the intake channel with a retaining device for a vacuum sealing operation.

* * * * *